US012624611B2

(12) United States Patent
Fripp et al.

(10) Patent No.: US 12,624,611 B2
(45) Date of Patent: May 12, 2026

(54) EXPANDING METAL FOR PLUG AND ABANDONMENT

(71) Applicant: Halliburton Energy Services, Inc., Houston, TX (US)

(72) Inventors: Michael Linley Fripp, Carrollton, TX (US); Kenneth Craig Kaser, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/114,697

(22) Filed: Dec. 8, 2020

(65) Prior Publication Data

US 2022/0178222 A1 Jun. 9, 2022

(51) Int. Cl.
*E21B 33/12* (2006.01)
*E21B 17/10* (2006.01)

(52) U.S. Cl.
CPC ..... *E21B 33/1208* (2013.01); *E21B 17/1021* (2013.01)

(58) Field of Classification Search
CPC .. E21B 33/1208; E21B 33/1212; E21B 33/12; E21B 33/136; E21B 27/02; E21B 17/1021
See application file for complete search history.

(56) References Cited

U.S. PATENT DOCUMENTS 5,667,015 A * 9/1997 Harestad ..... E21B 33/136 166/383
2011/0098202 A1* 4/2011 James ..... C09K 8/42 507/221
2015/0345248 A1* 12/2015 Carragher ..... E21B 33/136 166/57
2015/0368990 A1* 12/2015 Jewett ..... E21B 17/1028 166/241.6
2016/0024902 A1* 1/2016 Richter ..... E21B 43/267 166/250.01
2016/0137912 A1* 5/2016 Sherman ..... C09K 8/706 166/243
2016/0319633 A1 11/2016 Cooper et al.
2017/0198191 A1* 7/2017 Potapenko ..... E21B 33/138
2017/0306714 A1* 10/2017 Haugland ..... E21B 33/1275
(Continued)

FOREIGN PATENT DOCUMENTS

EP 3196402 A1 * 7/2017
WO 2019164499 A1 8/2019
(Continued)

OTHER PUBLICATIONS

A.F. Suter, "Binding Agents", available at https://www.afsuter.com/application/binding-agents (Year: 2022).*
(Continued)

*Primary Examiner* — Theodore N Yao
(74) *Attorney, Agent, or Firm* — Scot Richardson; Parker Justiss, P.C.

(57) ABSTRACT

Provided is an expandable metal plug for use in a wellbore tubular. The expandable metal plug, in one aspect, includes a downhole member positionable proximate a plug and abandonment section in a wellbore tubular, wherein at least a portion of the downhole member comprises a metal configured to expand in response to hydrolysis to seal the wellbore tubular.

27 Claims, 15 Drawing Sheets

(56) References Cited

U.S. PATENT DOCUMENTS

| | | | | |
|---|---|---|---|---|
| 2019/0128092 | A1* | 5/2019 | Mueller | E21B 33/1208 |
| 2019/0225861 | A1* | 7/2019 | Reddy | C04B 9/02 |
| 2019/0316025 | A1* | 10/2019 | Sherman | E21B 33/138 |
| 2019/0383115 | A1 | 12/2019 | Lees | |
| 2020/0370391 | A1 | 11/2020 | Fripp et al. | |

FOREIGN PATENT DOCUMENTS

| | | | |
|---|---|---|---|
| WO | 2020005252 | A1 | 1/2020 |
| WO | 2021173161 | A1 | 9/2021 |

OTHER PUBLICATIONS

Chuck Tinsley "Plugging and Abandonment", US Environmental Protection Agency, Jun. 2018, available from: https://www.epa.gov/sites/default/files/2018-06/documents/well_plugging_2018_-_chuck_tinsley.pdf (Year: 2018).*

Definition of "well integrity" from ISO TS 16530-2 "Well Integrity for the Operational Phase", p. 8. (Year: 2013).*

Fripp et al. "Novel Expanding Metal Alloy for Non-Elastomeric Sealing and Anchoring." Paper presented at the SPE Annual Technical Conference and Exhibition, Houston, Texas, USA, Oct. 2022. doi: https://doi.org/10.2118/210273-MS (Year: 2022).*

* cited by examiner

EXPANDING METAL FOR PLUG AND ABANDONMENT

BACKGROUND

Statutory regulations require pressure isolation, among other things, across reservoir zones in a subterranean well during plug and abandonment of the well. In this context, tubulars through such permeable zones may be required to be pressure-isolated at both the outside and the inside of the particular tubular in the well.

Traditionally, such plugging and abandonment is carried out by means of so-called milling technology. In this context, a mechanical milling tool is routed to a desired location in the particular tubular in the well. Then, a longitudinal section of the tubular is milled into pieces, after which ground up metal shavings, cement pieces, and/or heaving drilling mud or brine (e.g., that has set for a long time) are circulated out of the well. Subsequently, a so-called underreamer is routed into the tubular to drill a larger wellbore along said longitudinal section, and in such a way that the wellbore is enlarged diametrically by drilling into new formation along the longitudinal section. Next, a plugging material, typically cement slurry, is pumped down through the tubular string and out into the enlarged wellbore, and possibly into the annulus above and below the enlarged wellbore, thereby forming the plug.

BRIEF DESCRIPTION

Reference is now made to the following descriptions taken in conjunction with the accompanying drawings, in which.

DETAILED DESCRIPTION

Figure 1:
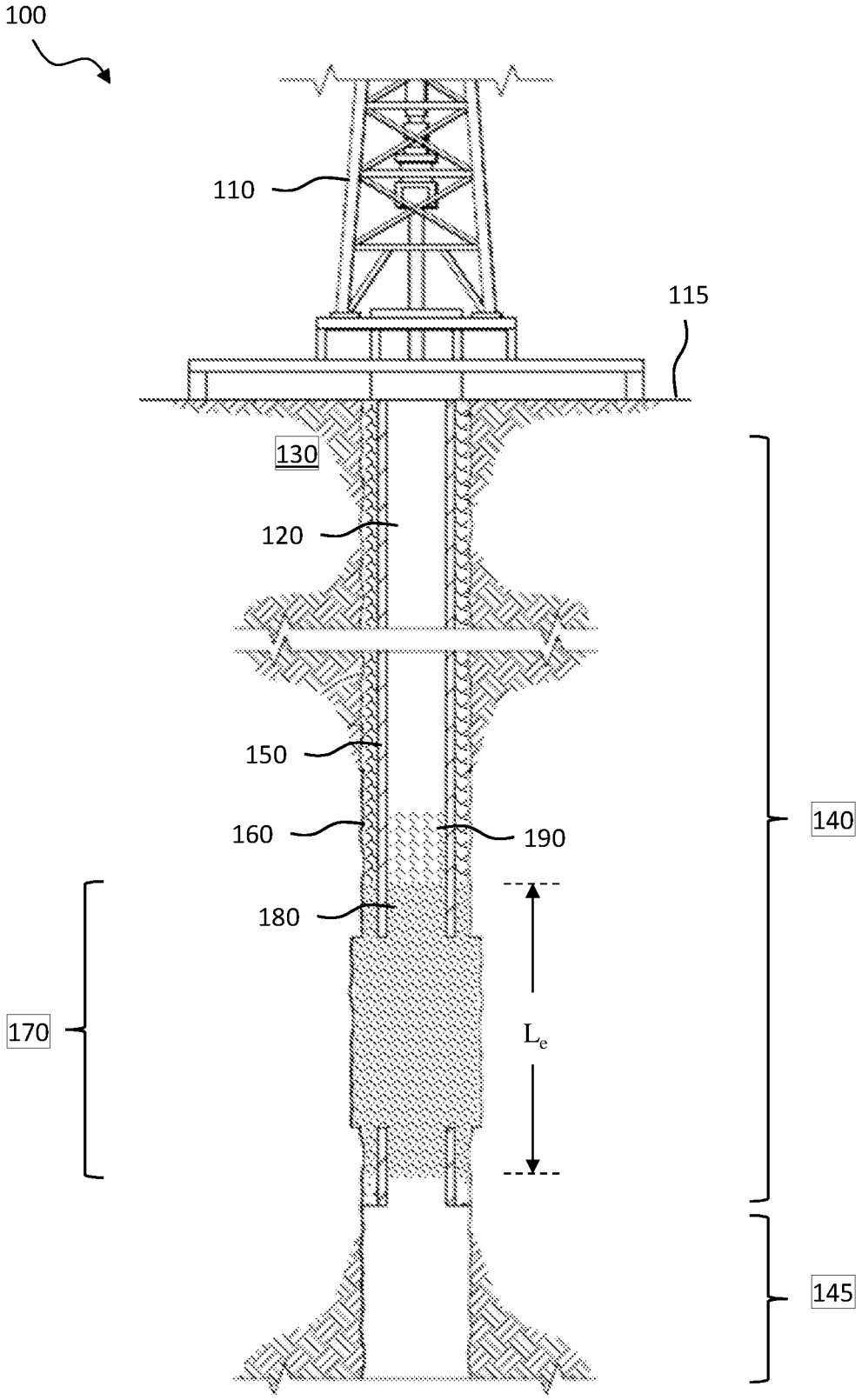
FIG. 1 depicts a well system including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Referring to FIG. 1, depicted is a well system 100 including an exemplary operating environment that the apparatuses, systems and methods disclosed herein may be employed. For example, the well system 100 could include an expanded metal plug 180 (e.g., permanent, temporary, etc.) according to any of the embodiments, aspects, applications, variations, designs, etc. disclosed in the following paragraphs. As depicted, the well system 100 includes a workover and/or drilling rig 110 that is positioned above the earth's surface 115 and extends over and around a wellbore 120 that penetrates a subterranean formation 130 for the purpose of recovering hydrocarbons. The subterranean formation 130 may be located below exposed earth, as shown, as well as areas below earth covered by water, such as ocean or fresh water. As those skilled in the art appreciate, the wellbore 120 may be fully cased, partially cased, have multiple concentric tubular strings, or an open hole wellbore. The casing may also be a liner that extends partway to the surface. In the illustrated embodiment of FIG. 1, the wellbore 120 is partially cased, and thus includes a cased region 140 and an open hole region 145.

The wellbore 120 may be drilled into the subterranean formation 130 using any suitable drilling technique. In the example illustrated in FIG. 1, the wellbore 120 extends substantially vertically away from the earth's surface 115. Notwithstanding, in other embodiments the wellbore 120 could include a vertical wellbore portion, deviate from vertical relative to the earth's surface 115 over a deviated wellbore portion, and then transition to a horizontal wellbore portion. In alternative operating environments, all or portions of a wellbore 120 may be vertical, deviated at any suitable angle, horizontal, and/or curved. The wellbore 120 may be a new wellbore, an existing wellbore, a straight wellbore, an extended reach wellbore, a sidetracked wellbore, a multi-lateral wellbore, or any other type of wellbore for drilling, completing, and/or the production of one or more zones. Further, the wellbore 120 may be used for both producing wells and injection wells.

In accordance with the disclosure, the wellbore 120 may include a wellbore tubular 150. The wellbore tubular 150, in the illustrated embodiment of FIG. 1, is wellbore casing that is held in place by cement 160 in the cased region 140. In alternative embodiments, the wellbore tubular 150 is production tubing, a liner, the wellbore itself, or any other type of tubular that might be located within a wellbore. In particular, a wellbore tubular includes any tubular having an annulus that surrounds it, as might be found with a concentric set of wellbore tubulars. While the wellbore tubular 150 is illustrated in FIG. 1 as being located in the cased region 140, other embodiments exist wherein the wellbore tubular 150 is located in the open hole region 145.

In the illustrated embodiment of FIG. 1, a longitudinal section of the wellbore tubular 150 has been removed proximate a plug and abandonment section 170 of the well system 100. The plug and abandonment section 170 of the well system 100 need not be a permanent plug and abandonment, but could be a temporary plug and abandonment, for example using a bridge plug or other temporary abandonment structure. Further to the embodiment of FIG. 1, the wellbore 120 in the plug and abandonment section 170 has been diametrically enlarged. Accordingly, in the embodiment of FIG. 1 a diameter of the wellbore 120 in the plug and abandonment section 170 is larger than a diameter of the wellbore 120 directly above and below the plug and abandonment section 170. Further to the embodiment of FIG. 1, the cement 160 in the annulus surrounding the wellbore tubular 150 has been removed a short distance above and below the plug and abandonment section 170.

The expanded metal plug 180, in accordance with one or more embodiments of the disclosure, includes a downhole member positioned proximate the plug and abandonment section 170 in the wellbore tubular 150. In accordance with one or more embodiments of the disclosure, at least a portion of the downhole member comprises a metal configured to expand in response to hydrolysis to seal the wellbore tubular 150. In the illustrated embodiment of FIG. 1, the downhole member has expanded to substantially fill an area of the plug and abandonment section 170. For example, the downhole member has expanded to substantially plug a section of the remaining wellbore tubular 150 directly above and below the plug and abandonment section 170. The downhole member, in the illustrated embodiment, has additionally expanded to substantially plug the diametrically enlarged area of the wellbore 120, and in the illustrated embodiment expanded radially into at least a portion of the exposed annulus surrounding the wellbore tubular 150 above and below the plug and abandonment section 170.

The expanded metal plug 180, in one or more embodiments, has a volume of at least 3500 $cm^3$. In certain embodiments, the expanded metal plug 180 has a volume of at least 775,000 $cm^3$. Similarly, in certain embodiments, the expanded metal plug 180 has a length ($L_e$) of at least 90 cm, and in certain other embodiments a length ($L_e$) of at least 1500 cm. Nevertheless, the volume and/or length ($L_e$) of the expanded metal plug 180 should be sufficient to provide an adequate plug and/or seal in the wellbore 120, but otherwise is not limited to any specific values.

In certain embodiments, the expanded metal plug 180 includes residual unreacted metal. For example, in certain embodiments the expanded metal plug 180 is intentionally designed to include the residual unreacted metal. In such an embodiment, a volume of the expandable metal may be so great, or an amount of space surrounding the expandable metal may be so small, that the expandable metal may expand into contact with the surrounding (e.g., thus preventing remaining expandable metal from contacting the reactive fluid) prior to hydrolyzing all of the expandable metal. What may result is the residual unreacted metal. The residual unreacted metal has the benefit of allowing the expanded metal plug 180 to self-heal if cracks or other anomalies subsequently arise. Nevertheless, other embodiments may exist wherein no residual unreacted metal exists in the expanded metal plug 180.

The expanding metal, in some embodiments, may be described as expanding to a cement like material. In other words, the metal goes from metal to micron-scale particles and then these particles expand and lock together to, in essence, lock the expanded metal plug 180 in place. The reaction may, in certain embodiments, occur in less than 2 days in a reactive fluid and in downhole temperatures. Nevertheless, the time of reaction may vary depending on the reactive fluid, the expandable metal used, and the downhole temperature.

In some embodiments, the reactive fluid may be a brine solution such as may be produced during well completion activities, and in other embodiments, the reactive fluid may be one of the additional solutions discussed herein. The metal, pre-expansion, is electrically conductive in certain embodiments. The metal may be machined to any specific size/shape, extruded, formed, cast or other conventional ways to get the desired shape of a metal, as will be discussed in greater detail below. Metal, pre-expansion, in certain embodiments has a yield strength greater than about 8,000 psi, e.g., 8,000 psi+/−50%. It has been measured that the post expansion expanded metal plug can hold over 3,000 psi in a 4½" tubing with an 18" long plug, which is about 160 psi per inch. In certain other embodiments, the expanded metal plug may hold at least 300 psi per inch of plug length.

The hydrolysis of the metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reactions uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases.

In an embodiment, the metallic material used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The metal alloy can be constructed in a solid solution process where the elements are combined with molten metal or metal alloy. Alternatively, the metal alloy could be constructed with a powder metallurgy process. The metal can be cast, forged, extruded, sintered, welded, mill machined, lathe machined, stamped, eroded or a combination thereof.

Optionally, non-expanding components may be added to the starting metallic materials. For example, ceramic, elastomer, plastic, epoxy, glass, or non-reacting metal components can be embedded in the expanding metal or coated on the surface of the metal. Alternatively, the starting metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expanding metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for fully expanding. For example, the expandable metal may be formed into a single long member, multiple short members, rings, alternating steel and swellable rubber and expandable metal rings, among others. In certain other embodiments, the pre-expansion downhole member is a collection of individual separate chunks of the metal held together with a binding agent proximate the plug and abandonment section in the wellbore tubular. In yet other embodiments, the pre-expansion downhole member is a collection of individual separate chunks of the metal that are not held together with a binding agent, as will be discussed in greater detail below. Additionally, a coating may be applied to one or more portions of the expandable metal to delay the expanding reactions.

In practice, the downhole member comprising the metal configured to expand in response to hydrolysis can be moved down the wellbore 120 via a downhole conveyance (not shown) to a desired location. In other embodiments, the downhole member comprising the metal configured to expand in response to hydrolysis may be pumped downhole, for example using a chute, radially deployable chute, parachute, umbrella, or other similar feature, coupled to the downhole member, along with fluid pressure supplied from the surface of the well system 100. In yet other embodiments, the downhole member comprising the metal configured to expand in response to hydrolysis may be dump bailed downhole. Nevertheless, unless otherwise indicated, the present disclosure is not limited to any specific method for deploying the downhole member comprising the metal configured to expand in response to hydrolysis. Once the downhole member comprising the metal configured to expand in response to hydrolysis reaches the desired location, the downhole member may be set in place according to the disclosure. In one embodiment, the downhole member comprising the metal configured to expand in response to hydrolysis is subjected to a wellbore fluid sufficient to form the expanded metal plug 180, which expands into contact with the wellbore 120 to thereby plug and abandon the wellbore 120.

In the embodiment of FIG. 1, the expanded metal plug 180 is positioned in the cased region 140 of the wellbore 120. In other embodiments, the expanded metal plug 180 could be located in an open hole region 145 of the wellbore. In fact, the expandable metal is well suited to adjust to the surface irregularities that may exist in open hole situations. Moreover, the expandable metal, in certain embodiments, may penetrate into the formation of the open hole region 145 and create a bond into the formation, and thus not just at the surface of the formation. Accordingly, unless otherwise stated, the expanded metal plug 180 of the present disclosure is not limited for use with cased regions 140 or open hole regions 145.

The well system 100 illustrated in the embodiment of FIG. 1 may additionally include a cement plug 190 disposed above, and in certain embodiments in contact with, the expanded metal plug 180. As the expanded metal plug 180 is already in place, the cement plug 190 may be easily disposed there over. In certain situations, the cement plug 190 may be necessary to meet one or more existing statutory regulations associated with the plug and abandonment of the wellbore 120.

An expanded metal plug according to the disclosure has many benefits over previous plug and abandonment applications. For example, previous plug-and-abandon applications traditionally used a cement slurry in order to create the seal. The cement has the potential to contract during setting which can create a small crack for leaks. The expanded metal plug according to the disclosure does not use a cement slurry and instead uses an expanding metal in order to create a high-expansion cement-like seal. The new expanded metal plug expands to increase the sealing pressure on the casing. Moreover, with the expanded metal plug, there is no longer worry about downward movement of the cement slurry, poor well evaluation, poor mud removal, or insufficient cement slurry volume. For example, in a deviated wellbore, a slurry of cement can flow, however, because the expanded metal plug is placed were it is needed, all of these issues are minimized and the cement-like seal is held at its target location. Moreover, the high expansion and the ability to stack chunks of the expanding metal allows for the expanded metal plug to be created through tubing. Thus the production tubing can be cut away and the expanding metal can pass through tight restrictions uphole before being set in a larger space downhole, such as passing through the production tubing and creating a seal in the casing.

Figure 2:
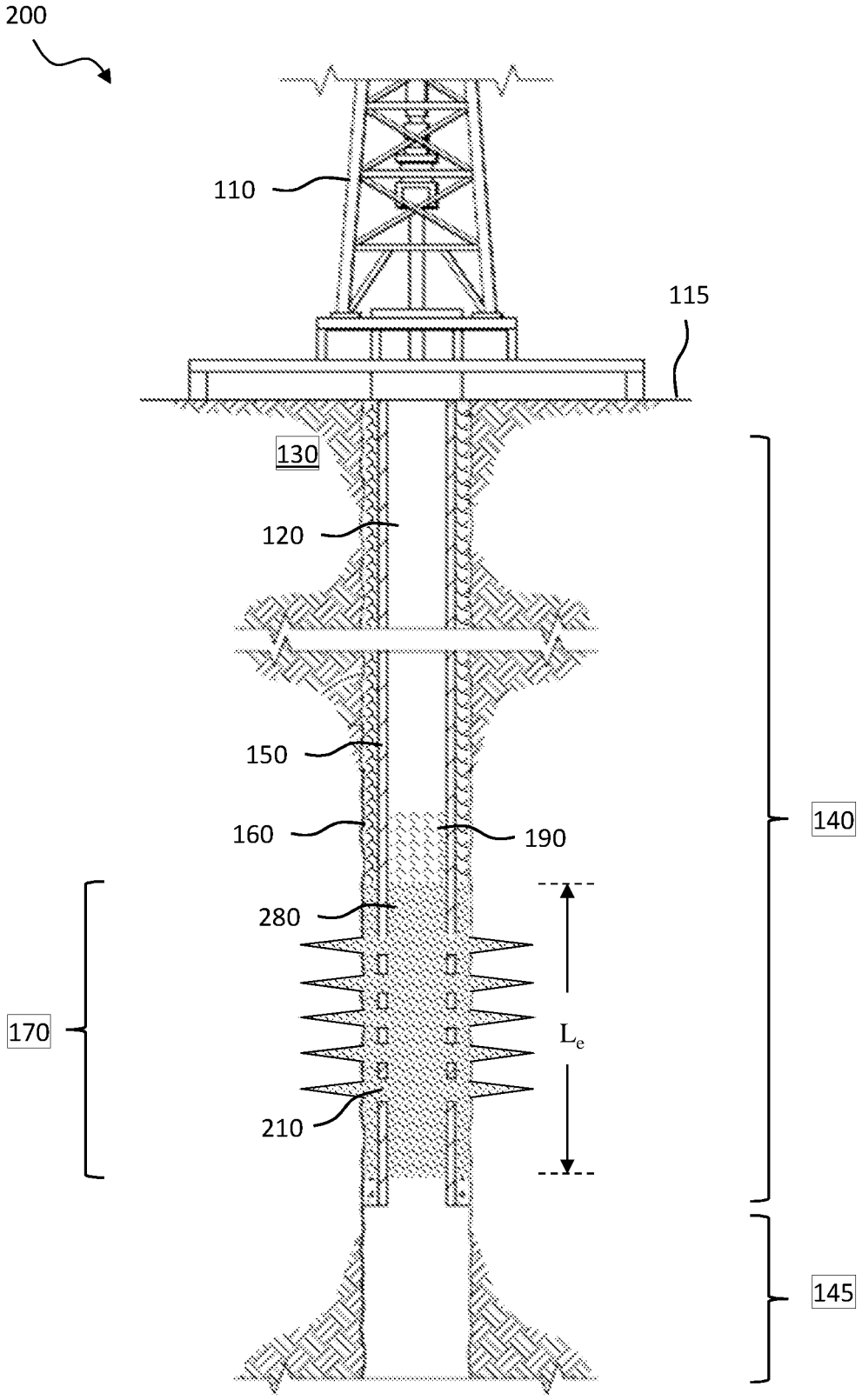
FIG. 2 depicts an alternative embodiment of a well system including an exemplary operating environment that the apparatuses, systems and methods disclosed herein may be employed.

Turning to FIG. 2, depicted is an alternative embodiment of a well system 200 designed, manufactured and operated according to the disclosure. The well system 200 of FIG. 2 is similar in many respects to the well system 100 of FIG. 1. Accordingly, like reference numbers have been used to indicate similar, if not substantially identical, features. The well system 200 differs, for the most part, from the well system 100, in that the well system 200 has not had the longitudinal section of the wellbore tubular 150 removed in the plug and abandonment section 170. In contrast, the well system 200 includes a plurality of perforations 210 in the wellbore tubular 150 in the plug and abandonment section 170. In certain embodiments, the plurality of perforations 210 extend past the wellbore tubular 150, for example past the wellbore 120 and into the subterranean formation 130.

The plurality of perforations 210 provide access to the annulus in the plug and abandonment section 170, and thus allow the cement 160 to be removed from the annulus. With the cement 160 removed from the annulus, the expanded metal plug 280 of FIG. 2 may expand to substantially plug a section of the remaining wellbore tubular 150 directly above and below the plug and abandonment section 170, additionally expand to substantially extend into the plurality of perforations 210, and expand radially into at least a portion of the exposed annulus surrounding the wellbore tubular 150 above and below the plug and abandonment section 170. Moreover, when the plurality of perforations 210 extend into the subterranean formation 130, the expanded metal plug 280 may also expand further into the subterranean formation 130, as shown in FIG. 2. It should be noted that while the embodiment of FIG. 1 employs a milling or other similar technology to create the opening in the wellbore tubular 150, and the embodiment of FIG. 2 employs a perforation technology (e.g., using perforation charges, a mechanical perforator, etc.) to create the perforations 210 in the wellbore tubular 150, the present disclosure is not limited to any specific method for creating the openings in the wellbore tubular 150. For example, in another embodiment, fluid cutting might be employed to create the opening in the wellbore tubular 150.

Figure 3:
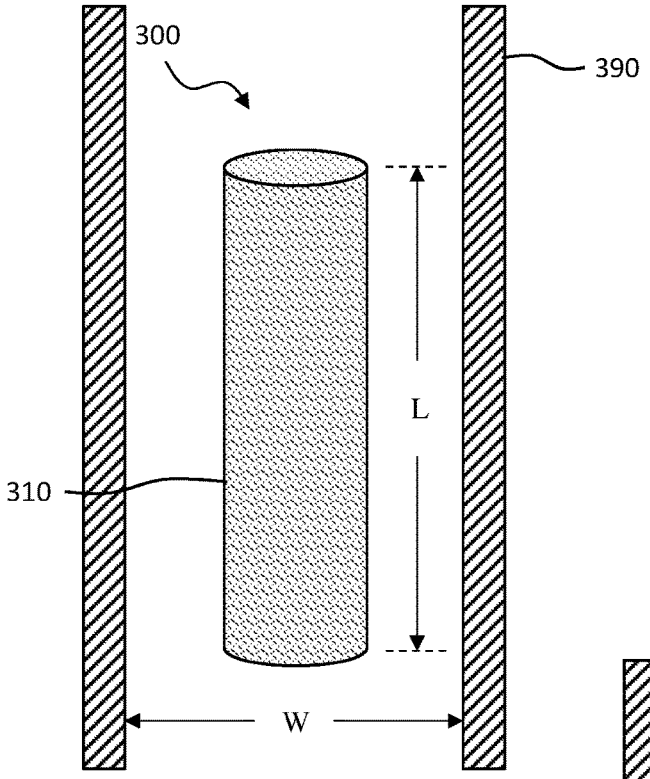
FIGS. 3 through 8 illustrate different embodiments of expandable metal plugs designed, manufactured and deployed according to the disclosure.

Turning to FIG. 3, illustrated is an expandable metal plug 300 (e.g., pre-expansion) designed, manufactured, and deployed according to one or more embodiments of the disclosure, as might be positioned in a wellbore tubular 390. The expandable metal plug 300, in accordance with one embodiment, includes a downhole member 310 (e.g., pre-expansion) positionable proximate a plug and abandonment section in the wellbore tubular 390. In the illustrated embodiment, at least a portion of the downhole member 310 comprises a metal configured to expand in response to hydrolysis to seal the wellbore tubular 390. The metal, in certain embodiments, is one or more of the metal discussed in the paragraphs above. In the illustrated embodiment of FIG. 3, the downhole member 310 is a single plug (e.g., single solid plug or single tubular plug) of the metal configured to expand in response to the hydrolysis. The downhole member 310, in this embodiment, might have a length (L) greater than a width (W) of the wellbore tubular 390, and could be deployed downhole using a downhole conveyance, such as a wireline or slickline, among others.

Figure 4:
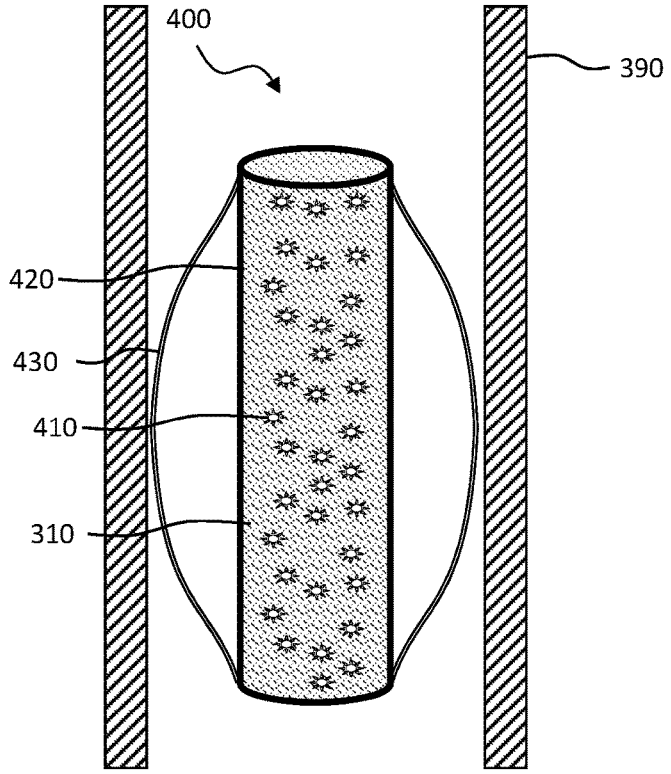

Turning to FIG. 4, illustrated is an expandable metal plug 400 (e.g., pre-expansion) designed, manufactured, and deployed according to one or more alternative embodiments of the disclosure. The expandable metal plug 400 of FIG. 4 is similar in many respects to the expandable metal plug 300 of FIG. 3. Accordingly, like reference numbers have been used to indicate similar, if not substantially identical, features. The expandable metal plug 400 differs, for the most part, from the expandable metal plug 300, in that the expandable metal plug 400 includes a mixture of the metal configured to expand in response to the hydrolysis, as well as a low melting point metal 410. The low melting point metal 410, in one embodiment is a fusible alloy, for example having a melting point between about 40 degrees centigrade and 200 degrees centigrade higher than the location within the subterranean formation that it will ultimately be deployed. When deployed, an exothermic reaction caused by the metal configured to expand in response to the hydrolysis increases the temperature of the low melting point metal 410, and thus the two metals combine to provide a stronger and more durable expandable metal plug 400. Additionally, the fusible alloys may expand when they solidify, which again helps provide a better seal. The fusible alloy may be an alloy containing bismuth, antimony, gallium, tin, zinc, lead, indium, or cadmium. The fusible allow may be a eutectic or a non-eutectic alloy.

The expandable metal plug 400 also differs from the expandable metal plug 300, in that the expandable metal plug 400 further includes a coating 420 substantially surrounding the downhole member 310. The coating 420, in one or more embodiments, is configured to delay the expansion of the metal in response to hydrolysis. The coating 420 may comprise any know material and/or thickness sufficient to delay the expansion of the metal for a given period of time. In one embodiment, however, the coating 420 comprises a metal (e.g., including bismuth), a polymer or glass. In another embodiment, the coating 420 is a fluorocarbon solid coating (e.g., PTFE coating), a wax, grease, or a paint. The coating may degrade in the downhole fluid, such as a PGA, a PLA, a urethane, an aliphatic polyester, sobitan monooleate, or glycerin monoricinoleate. The coating may degrade at the downhole temperature, such as a polymer or a fusible alloy that has a melting temperature (phase change temperature) less than the formation temperature. The coating can be considered to be a delay barrier that serves to temporarily inhibit the hydration reaction. In some cases the coating is a formed from an oxidation reaction on the reactive metal, such as from an anodizing reaction, a plasma electrolytic oxidation reaction, or a zirconium dioxide coating. In other cases, the coating is applied with a carrier fluid, with chemical vapor deposition, physical vapor deposition, spray, dip, electrodeposition, autocatalytic reaction, vacuum evaporation, or a combination of processes.

The expandable metal plug 400 also differs from the expandable metal plug 300, in that the expandable metal plug 400 further includes two or more expandable centralizers 430 coupled to the downhole member 310. The expandable centralizers 430, in one embodiment, are two or more spring loaded centralizers. Accordingly, the expandable centralizers 430 allow the downhole member 310 to traverse smaller diameter wellbore tubulars, and when necessary expand radially outward to position the downhole member 310 within the wellbore tubular 390.

Figure 5:
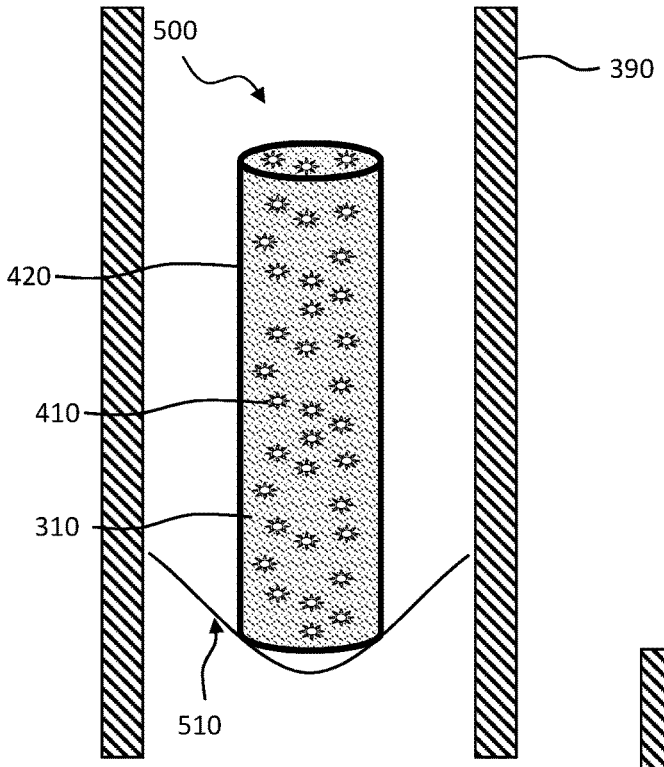

Turning to FIG. 5, illustrated is an expandable metal plug 500 (e.g., pre-expansion) designed, manufactured, and deployed according to one or more alternative embodiments of the disclosure. The expandable metal plug 500 of FIG. 5 is similar in many respects to the expandable metal plug 400 of FIG. 4. Accordingly, like reference numbers have been used to indicate similar, if not substantially identical, features. The expandable metal plug 500 differs, for the most part, from the expandable metal plug 400, in that the expandable metal plug 500 includes a radially deployable chute 510 coupled to the downhole member 310. In the illustrated embodiment, the radially deployable chute 510 may comprise a wiper or a cup, and thus be configured to catch fluid travelling through the wellbore tubular 390 and push the expandable metal plug 500 downhole proximate the plug and abandonment section. Thus, while the expandable metal plugs 300, 400 were deployed using a downhole conveyance, the expandable metal plug 500 could conceivably be deployed downhole simply using fluid from the surface.

The radially deployable chute 510 may comprise a variety of different materials and remain within the scope of the disclosure. In the illustrated embodiment, the radially deployable chute 510 comprises metal. In fact, the radially deployable chute 510 could comprise the same low melting point metal as discussed in FIG. 4. Additionally, the radially deployable chute 510 could comprise plastic, rubber or any other suitable material. Although FIG. 5 shows a single radially deployable chute 510 on the bottom of the expandable metal plug 500, the radially deployable chute 510 may be in the middle or on the top of the expandable metal plug 500 and multiple chutes may be employed. The multiple chutes may have different diameters so that they may create a seal in multiple diameter tubing.

Figure 6:
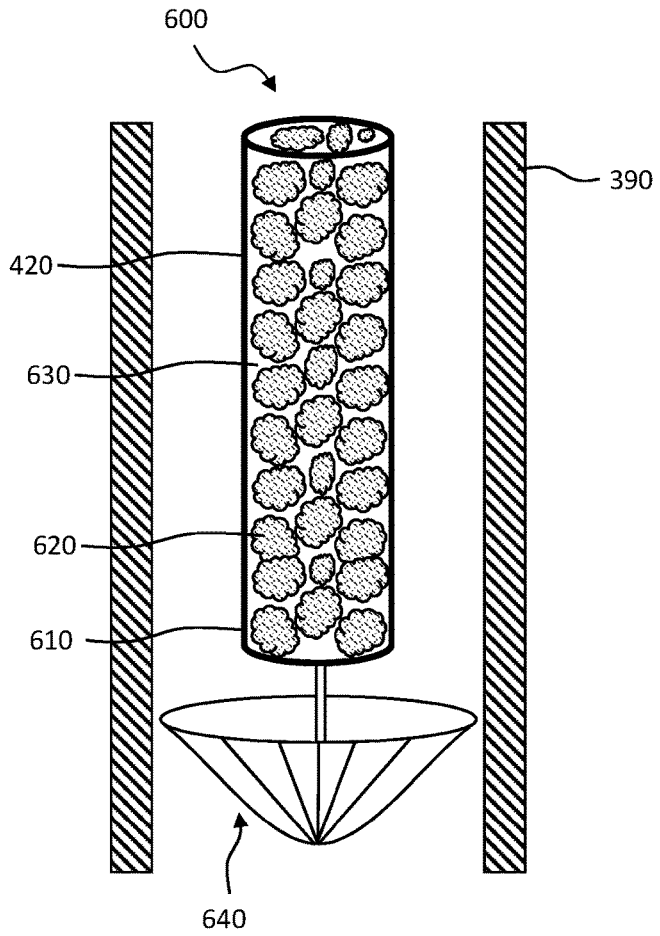

Turning to FIG. 6, illustrated is an expandable metal plug 600 (e.g., pre-expansion) designed, manufactured, and deployed according to one or more alternative embodiments of the disclosure. The expandable metal plug 600 of FIG. 6 is similar in certain respects to the expandable metal plug 400 of FIG. 4. Accordingly, like reference numbers have been used to indicate similar, if not substantially identical, features. The expandable metal plug 600, in contrast to the expandable metal plug 400, includes a downhole member 610 with a collection of individual separate chunks of the metal 620 held together with a binding agent 630. In theory, the binding agent 630 would dissolve over time thereby allowing the individual separate chunks of the metal 620 to expand via the hydrolysis. The binding agent 630, in one embodiment is salt, but the present disclosure is not limited to any specific binding agent.

In certain embodiments, the collection of individual separate chunks of the metal 620 are a collection of individual separate different sized chunks of the metal. For example, in certain embodiments a volume of the largest most individual chunk of the metal is at least 5 times the volume of the smallest most individual chunk of the metal. In yet other embodiments, a volume of the largest most individual chunk of the metal is at least 50 times a volume of the smallest most individual chunk of the metal. If the individual separate chunks of the metal 620 were spheres, in certain embodiments a diameter of the largest most individual chunk of the metal might be at least 2 times a diameter of the smallest most individual chunk of the metal, and in yet another embodiment a diameter of the largest most individual chunk of the metal might be at least 10 times a diameter of the smallest most individual chunk of the metal. The variation in sizes of the individual separate chunks of the metal 620 allow the individual chunks to reach places where they might not otherwise desirably reach, as well as prevent the individual separate chunks of the metal 620 from reaching places they might otherwise undesireably reach.

The expandable metal plug 600, in the illustrated embodiment, further includes a radially deployable chute 640 coupled to the collection of individual separate chunks of the metal 620 held together with the binding agent 630. The radially deployable chute 640 is configured to catch the individual separate chunks of the metal 620 when the binding agent 630 dissolves. Accordingly, the radially deployable chute 640 stops the individual separate chunks of the metal 620 at the appropriate location in the wellbore tubular 390, and thus allows the individual separate chunks of the metal 620 to expand in response to the hydrolysis and form an expanded metal plug.

The radially deployable chute 640 may comprise a variety of different materials and remain within the scope of the disclosure. In the illustrated embodiment, the radially deployable chute 640 comprises metal. In fact, the radially deployable chute 640 could comprise the same low melting point metal as discussed in FIG. 4. Additionally, the radially deployable chute 640 could comprise plastic, rubber or any other suitable material.

Figure 7:
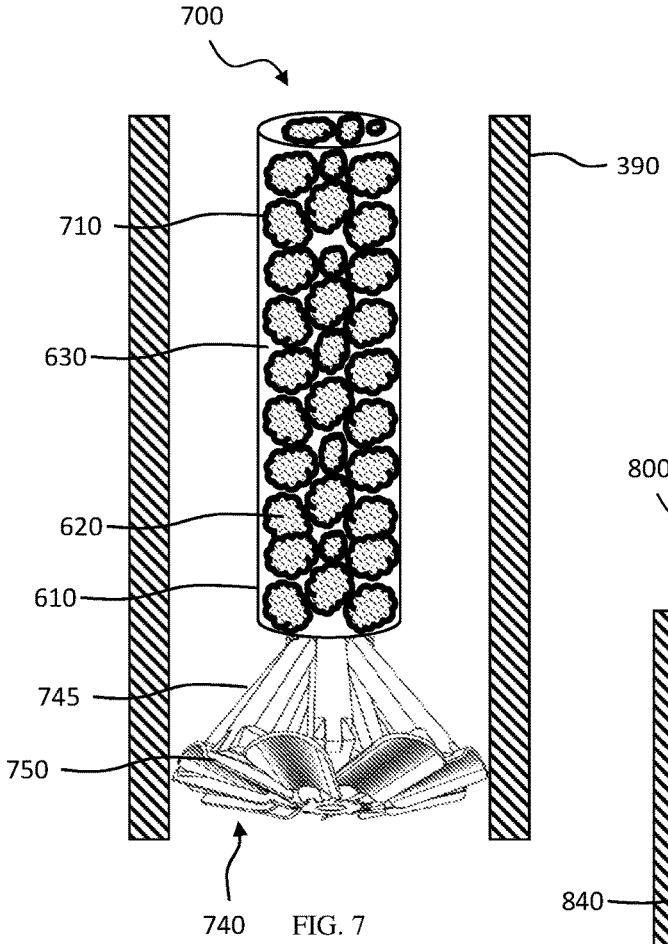

Turning to FIG. 7, illustrated is an expandable metal plug 700 (e.g., pre-expansion) designed, manufactured, and deployed according to one or more alternative embodiments of the disclosure. The expandable metal plug 700 of FIG. 7 is similar in many respects to the expandable metal plug 600 of FIG. 6. Accordingly, like reference numbers have been used to indicate similar, if not substantially identical, features. The expandable metal plug 700 differs, for the most part, from the expandable metal plug 600, in that the expandable metal plug 600 includes a coating 710 substantially surrounding each of the individual chunks of metal 620, the coating 710 configured to delay the expansion of the metal in response to hydrolysis. The coating 710 may be similar, in certain embodiments, to the coating 420 described above with regard to FIG. 4. The expandable metal plug 700 additionally includes an alternative embodiment of a radially deployable chute 740. The radially deployable chute 740, in the illustrated embodiment, includes a collection of link arms 745 that move relative to each other to radially deploy one or more petals 750. The petals 750, in the illustrated embodiment, are configured to catch the individual separate chunks of the metal 620 when the binding agent 630 dissolves.

Figure 8:
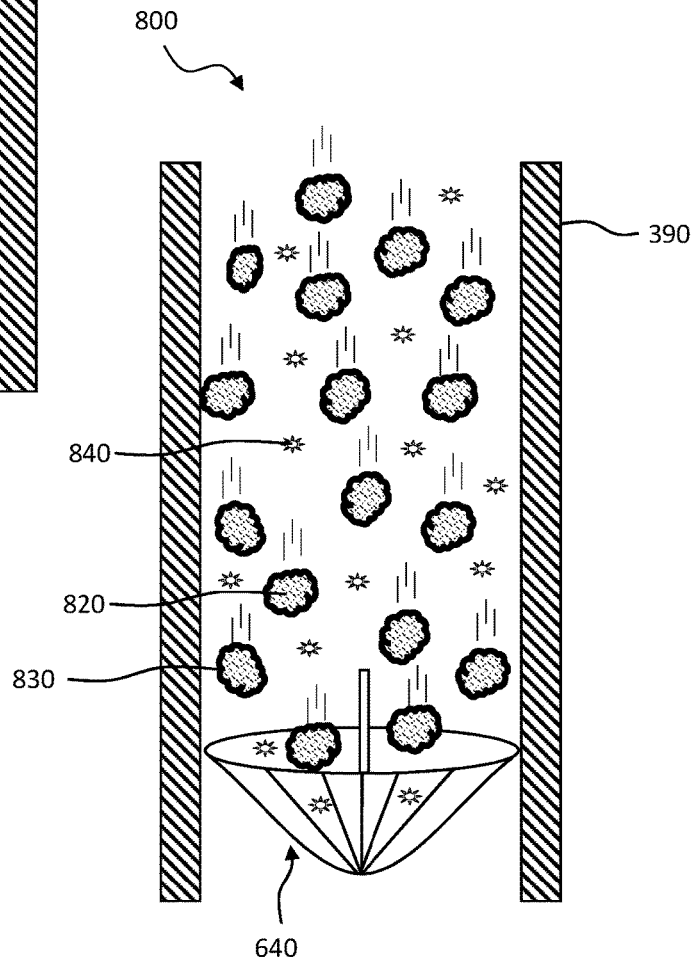

Turning to FIG. 8, illustrated is an expandable metal plug 800 (e.g., pre-expansion) designed, manufactured, and operated according to one or more alternative embodiments of the disclosure. The expandable metal plug 800 of FIG. 8 is similar in certain respects to the expandable metal plug 600 of FIG. 6 and expandable metal plug 700 of FIG. 7. Accordingly, like reference numbers have been used to indicate similar, if not substantially identical, features. The expandable metal plug 800 differs, for the most part, from the expandable metal plugs 600, 700, in that the expandable metal plug 600 does not employ the binding agent 630, but in turn allows its collection of individual separate chunks of the metal 820 to individually drop within the wellbore tubular 390 and be collected, for example by the radially deployable chute 640. Further to the embodiment of FIG. 8, a coating 830 substantially surrounds each of the individual chunks of metal, the coating 830 configured to delay the expansion of the metal in response to hydrolysis. The coating 830 may be similar, in certain embodiments, to the coating 710 described above with regard to FIG. 7. Further to the embodiment of FIG. 8, individual chunks of a low melting point metal 840 may individually drop within the wellbore tubular 390, along with the individual separate chunks of the metal 820, and be collected by the radially deployable chute 640. The chunks may range in size from 1 mm to 100 mm and may be spheroidal, acicular, granular, or any other shape. The collection of individual separate chunks of the metal 820 and individual chunks of a low melting point metal 840, as well as the coating 830, may be pumped downhole and/or dump bailed, among other methods know to those skilled in the art.

Figure 9:
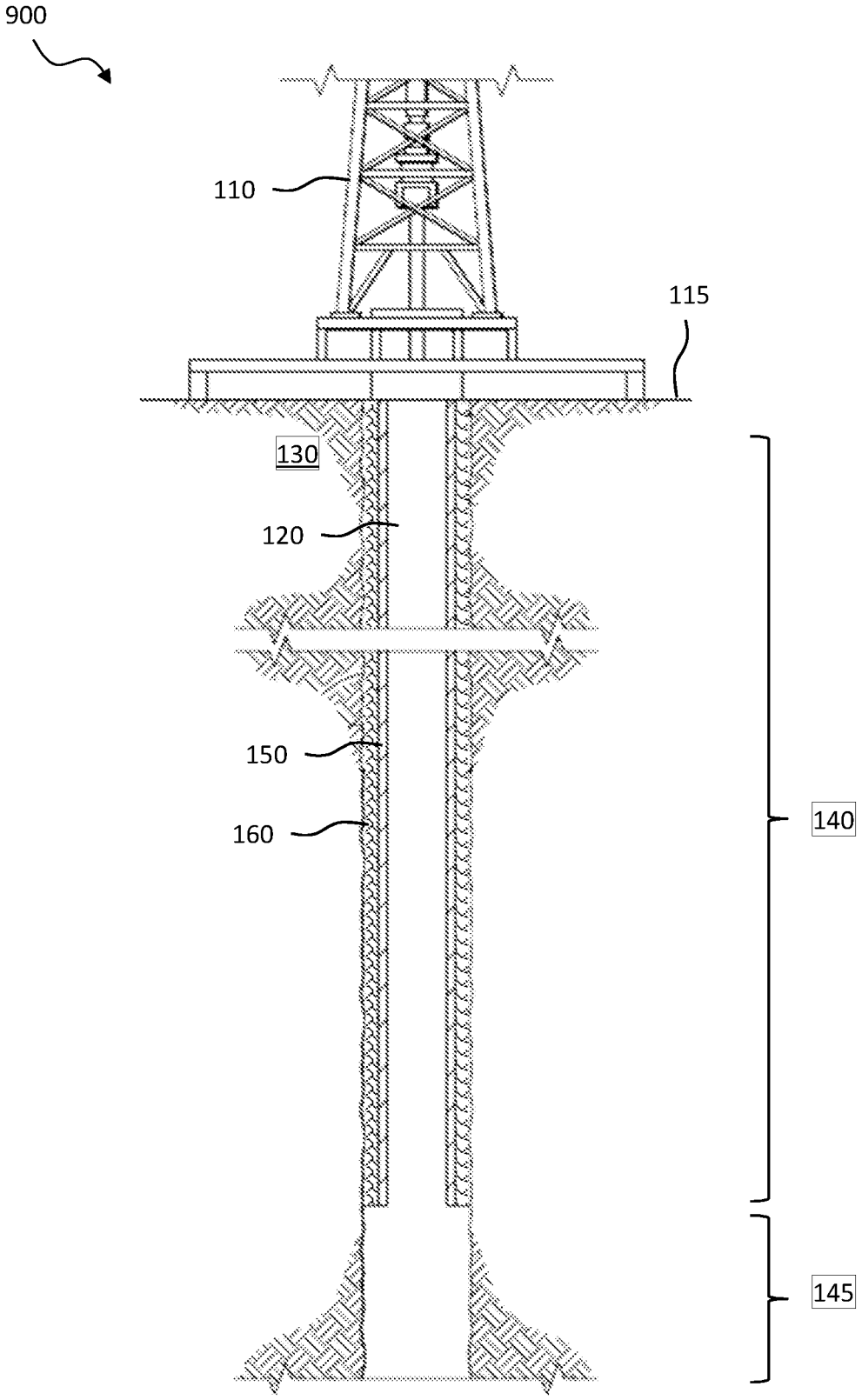
FIGS. 9 through 13 illustrate one embodiment of a method for plugging and abandoning a well system in accordance with the disclosure.

Turning now to FIGS. 9 through 13, illustrated is one embodiment of a method for plugging and abandoning a well system 900 in accordance with the disclosure. The well system 900 is similar in many respects to the well system 100 of FIG. 1. Accordingly, like reference numbers have been used to indicate similar, if not substantially identical, features. With initial reference to FIG. 9, the well system 900 includes the wellbore tubular 150 positioned within the wellbore 120. The well system 900 of FIG. 9 additionally includes cement 160 positioned in the annulus between the wellbore tubular 150 and the wellbore 120. Accordingly, the well system 900 illustrated in FIG. 9 is ready for being plugged and abandoned according to one or more embodiments of the disclosure.

Figure 10:
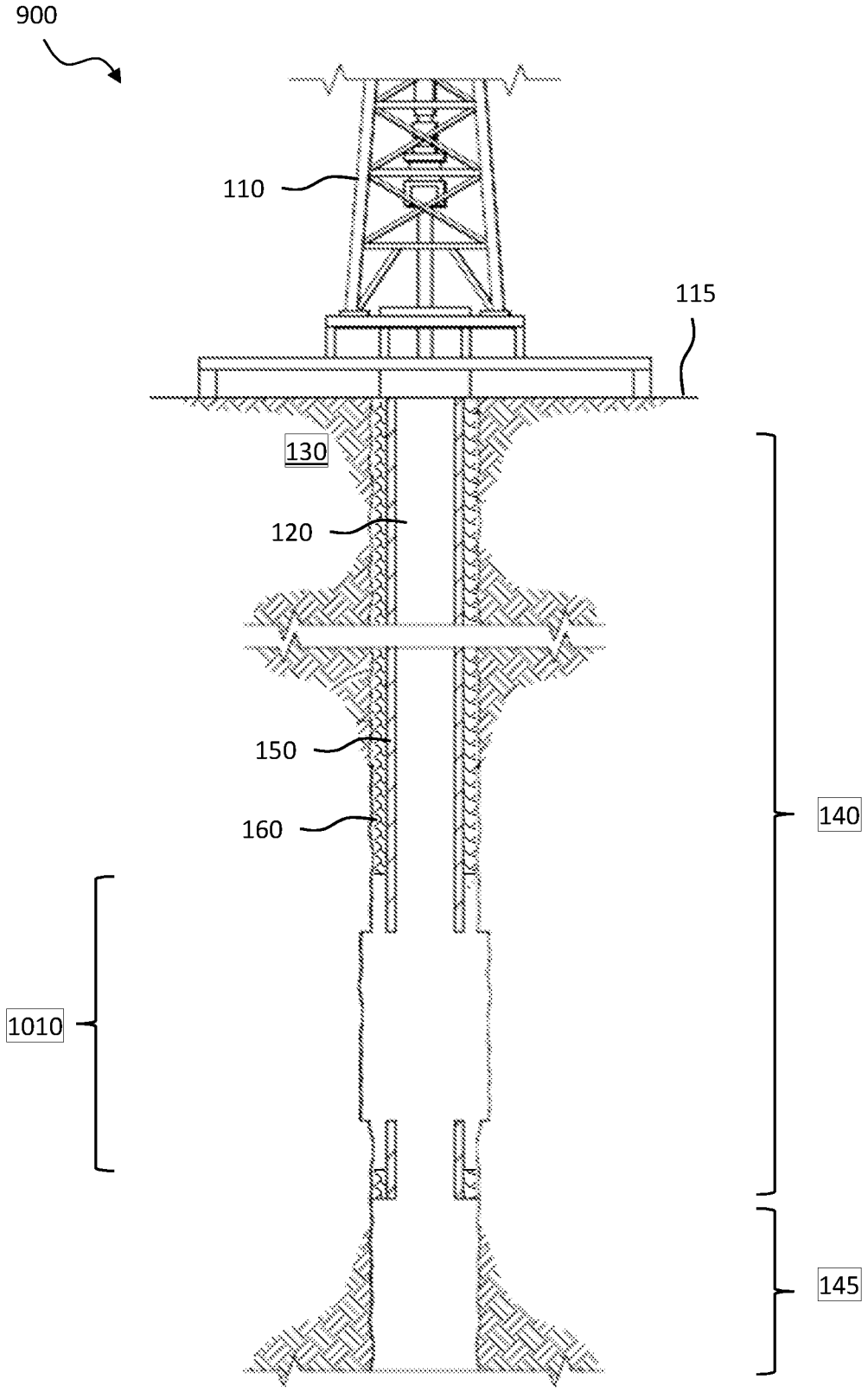

Turning now to FIG. 10, illustrated is the well system 900 of FIG. 9 after removing a longitudinal section of the wellbore tubular 150 in a plug and abandonment section 1010 of the well system 900. Furthermore, in the embodiment of FIG. 10 the wellbore 120 has been diametrically enlarged in the plug and abandonment section 1010. Additionally, the cement 160 in the annulus surrounding the wellbore tubular 150 has been removed a short distance above and below the plug and abandonment section 1010.

Those skilled in the art understand the myriad of different processes that might be used to remove the longitudinal section of the wellbore tubular 150, enlarge the wellbore 120, and remove the cement 160. Accordingly, unless otherwise required, the present disclosure should not be limited to any specific process.

Figure 11:
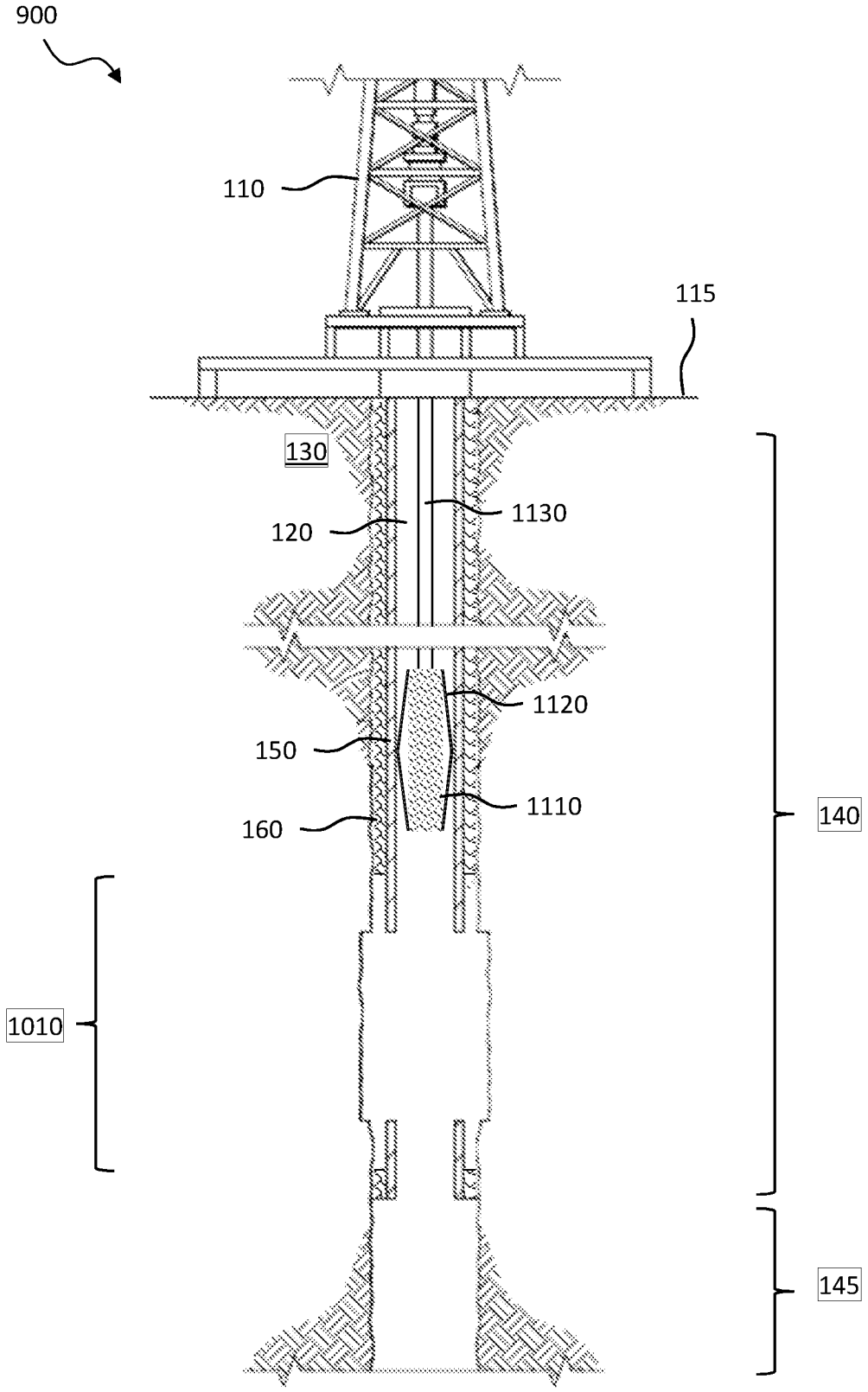

Turning now to FIG. 11, illustrated is the well system 900 of FIG. 10 after positioning an expandable metal plug 1110 designed and manufactured according to the disclosure within the wellbore tubular 150. In accordance with one embodiment, the expandable metal plug 1110 includes a pre-expansion downhole member, wherein at least a portion of the pre-expansion downhole member comprises the metal configured to expand in response to hydrolysis (e.g., as discussed above). The expandable metal plug 1110, in the illustrated embodiment, further includes two or more expandable centralizers 1120 coupled to the downhole member. With the expandable metal plug 1110 being located in the smaller diameter wellbore tubular 150, the two or more expandable centralizers 1120 are in a retracted or semi-retracted state.

In the illustrated embodiment, the expandable metal plug 1110 has been positioned in the wellbore tubular 150 using a wellbore conveyance 1130. Any wellbore conveyance 1130 may be used to position the expandable metal plug 1110 within the wellbore tubular 150. For example, the wellbore conveyance 1130 may be a wireline, a slickline, coiled tubing, rigid pipe, all of which may be deployed using a workover and/or drilling rig, or any other conveyance and remain within the scope of the disclosure. In certain embodiments, fluid and/or gravity act as the wellbore conveyance.

Figure 12:
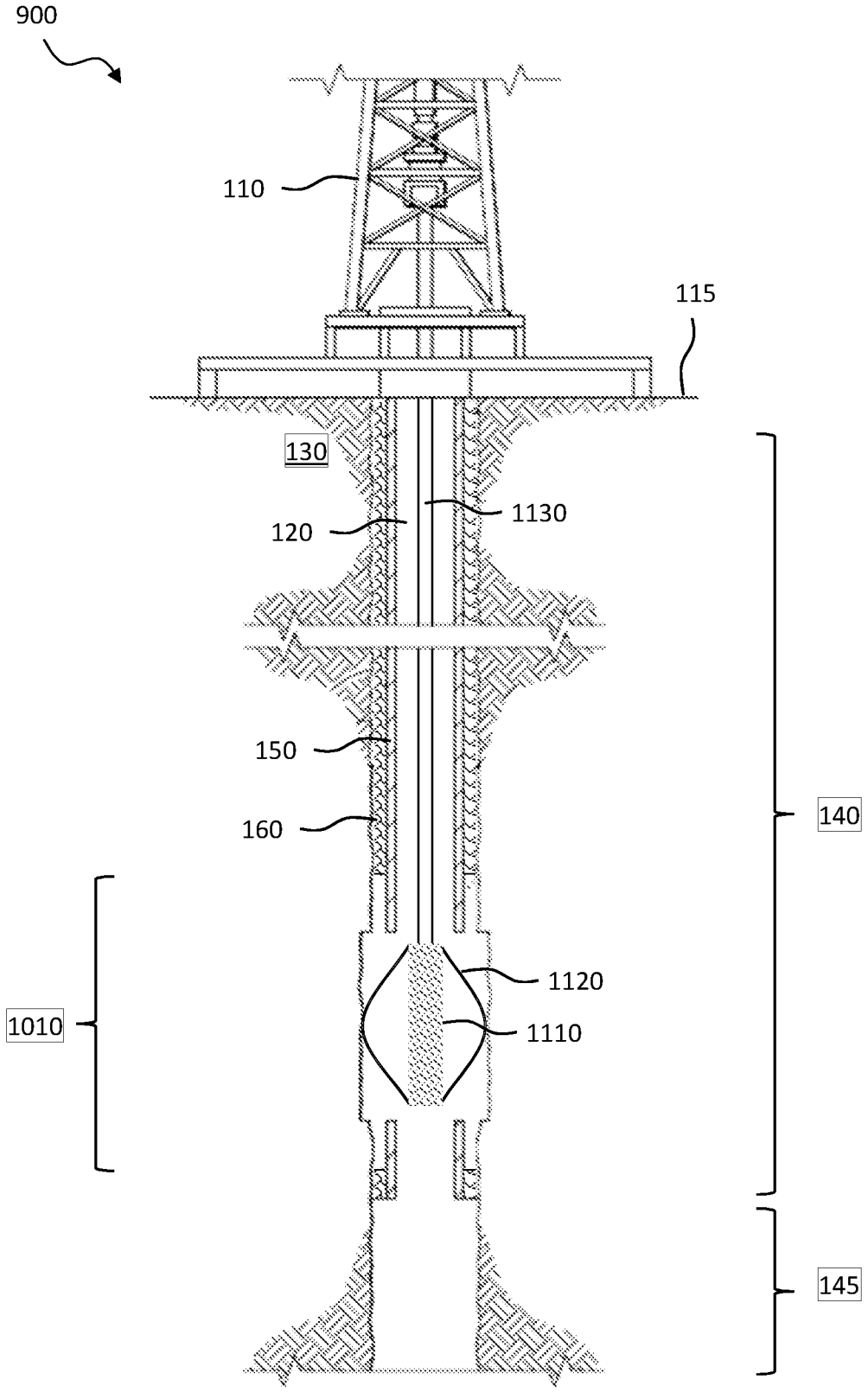

Turning now to FIG. 12, illustrated is the well system 900 of FIG. 11 after positioning the expandable metal plug 1110 proximate the plug and abandonment section 1010 in the wellbore tubular 150. As shown, as the expandable metal plug 1110 enters the plug and abandonment section 1010, and thus goes from the smaller diameter wellbore tubular 150 to the diametrically enlarged section of the wellbore 120, the two or more expandable centralizers 1120 radially expand to engage the exposed wellbore 120. Thus, according to this embodiment, the two or more expandable centralizers 1120 hold the expandable metal plug 1110 within the wellbore 120 until the metal has had sufficient time to expand in response to the hydrolysis and form a plug.

Figure 13:
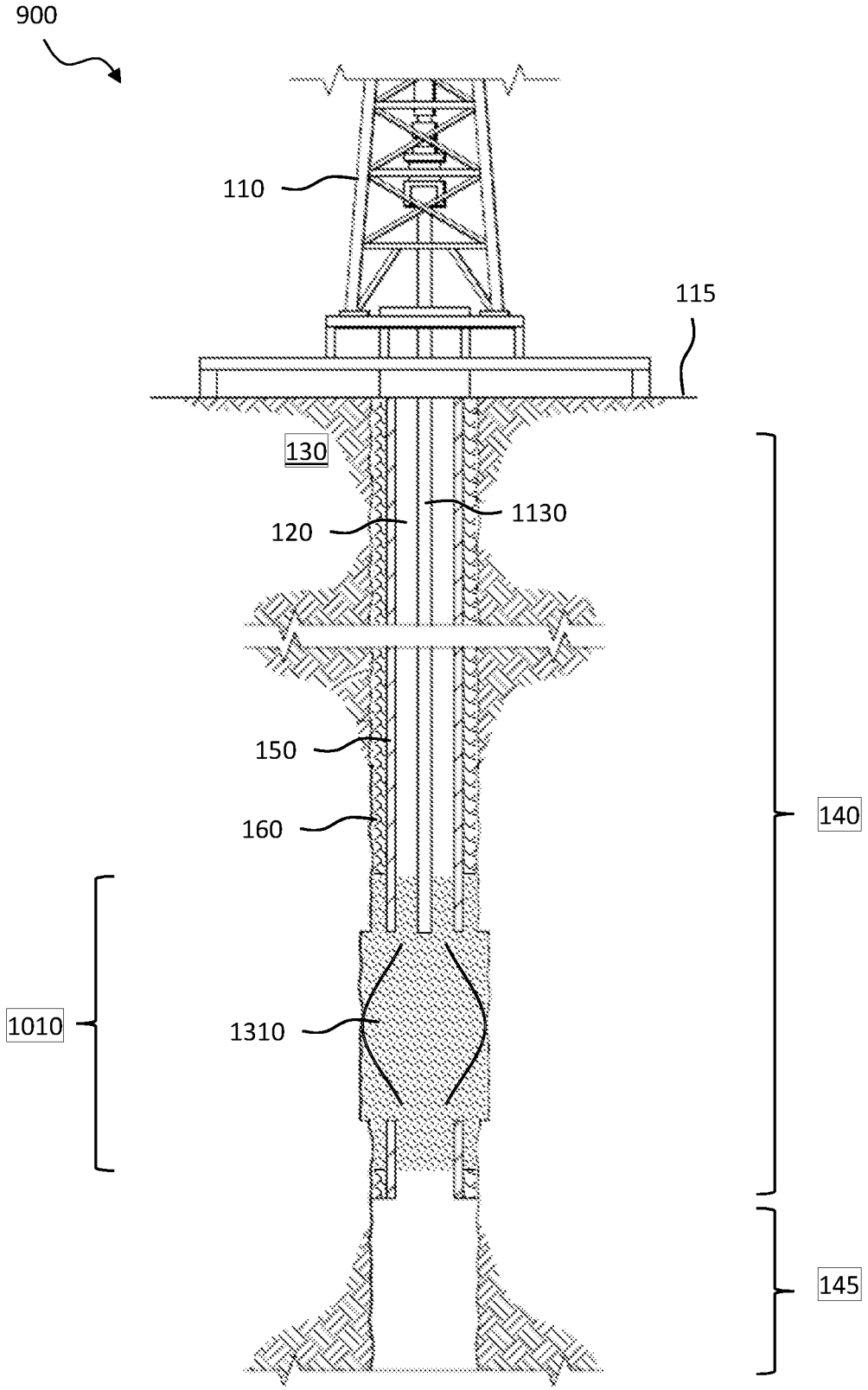

Turning now to FIG. 13, illustrated is the well system 900 of FIG. 12 after subjecting the pre-expansion downhole member to a wellbore fluid to expand the metal into contact with the wellbore tubular 150 and thereby plug the wellbore tubular. What results is an expanded metal plug 1310 plugging and abandoning the wellbore 120. For example, in the illustrated embodiment of FIG. 13, the downhole member has expanded to substantially plug an uphole and downhole portion of the remaining wellbore tubular 150 in the plug and abandonment section 1010. The downhole member, in the illustrated embodiment, has additionally expanded to substantially plug the diametrically enlarged area of the wellbore 120, and expanded radially into at least a portion of the exposed annulus surrounding the wellbore tubular 150 above and below the plug and abandonment section 1010. At this stage, the well system 900 would be considered plugged, and is thus ready for abandonment.

Turning now to FIGS. 14 through 18, illustrated is another embodiment of a method for plugging and abandoning a well system 1400 in accordance with the disclosure. With initial reference to FIG. 14, the well system 1400 is similar in many respects to the well system 900 of FIG. 10. The well system 1400 differs, for the most part, from the well system 900 of FIG. 10, in that the well system 1400 of FIG. 14 includes a radially deployable chute 1410 positioned in the wellbore tubular 150. With the radially deployable chute 1410 being located in the smaller diameter wellbore tubular 150, is may be in a retracted or semi-retracted state. The radially deployable chute 1410, in the illustrated embodiment, has been positioned and/or moved within the wellbore tubular 150 using fluid from above, as opposed to the wellbore conveyance 1130 discussed above.

Figure 14:
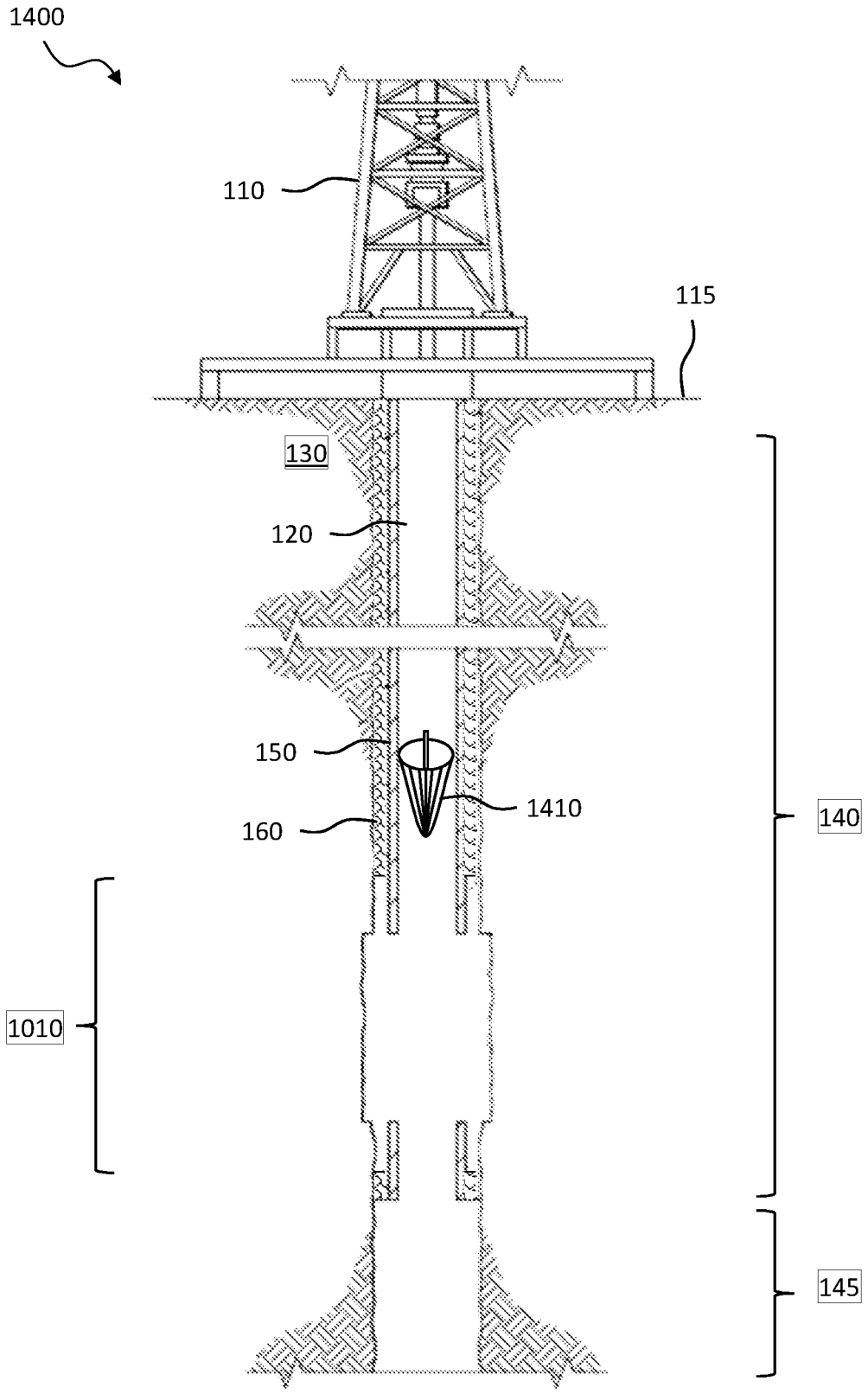
FIGS. 14 through 18 illustrate another embodiment of a method for plugging and abandoning a well system in accordance with the disclosure.
Figure 15:
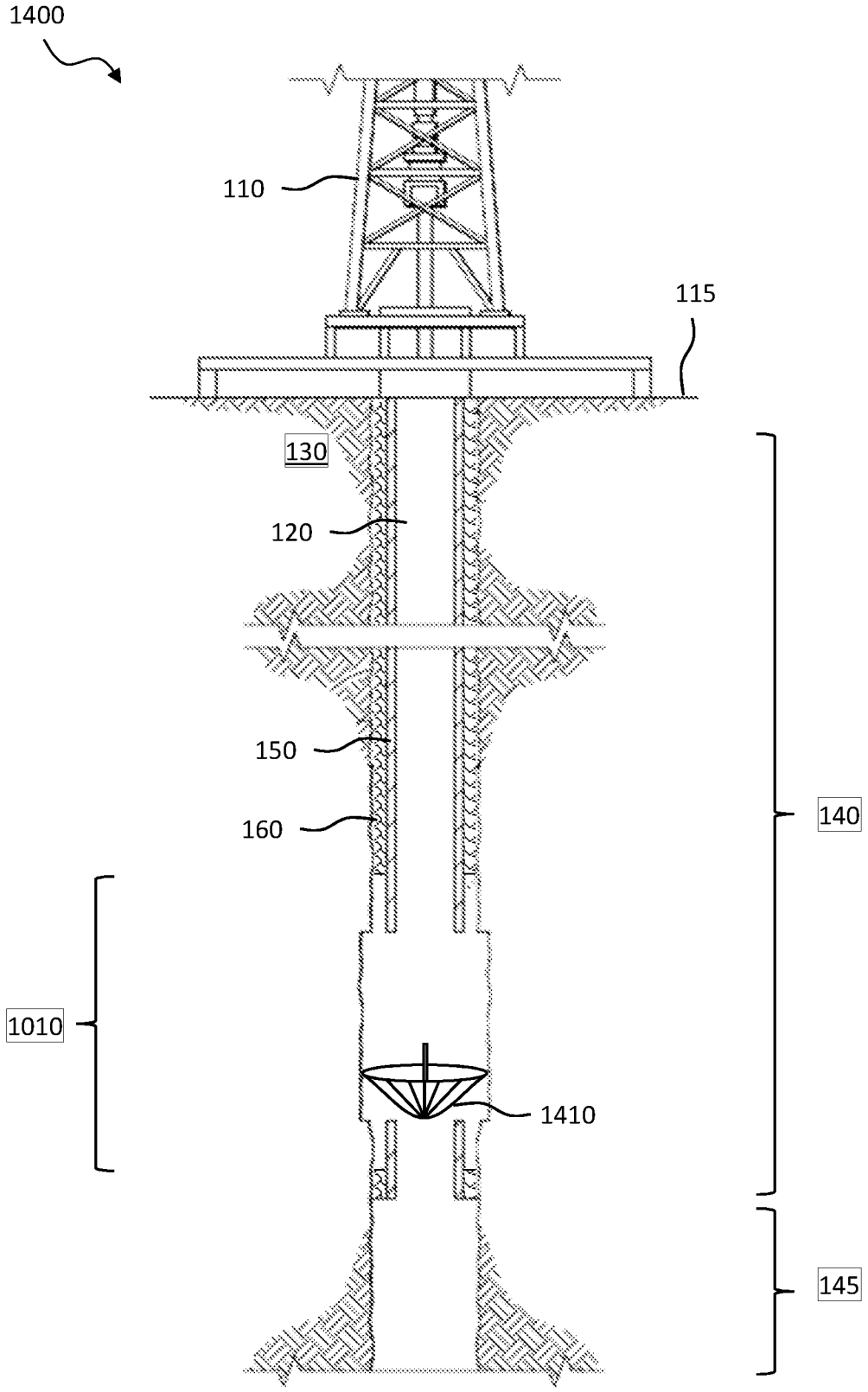

Turning now to FIG. 15, illustrated is the well system 1400 of FIG. 14 after placing the radially deployable chute 1410 in the wellbore tubular 150 proximate the plug and abandonment section 1010 in the wellbore tubular 150. As shown, as the radially deployable chute 1410 enters the plug and abandonment section 1010, and thus goes from the smaller diameter wellbore tubular 150 to the diametrically enlarged section of the wellbore 120, the radially deployable chute 1410 radially expands to engage the exposed wellbore 120. Again, fluid from above may be used to appropriately position the radially deployable chute 1410 in the plug and abandonment section 1010.

Figure 16:
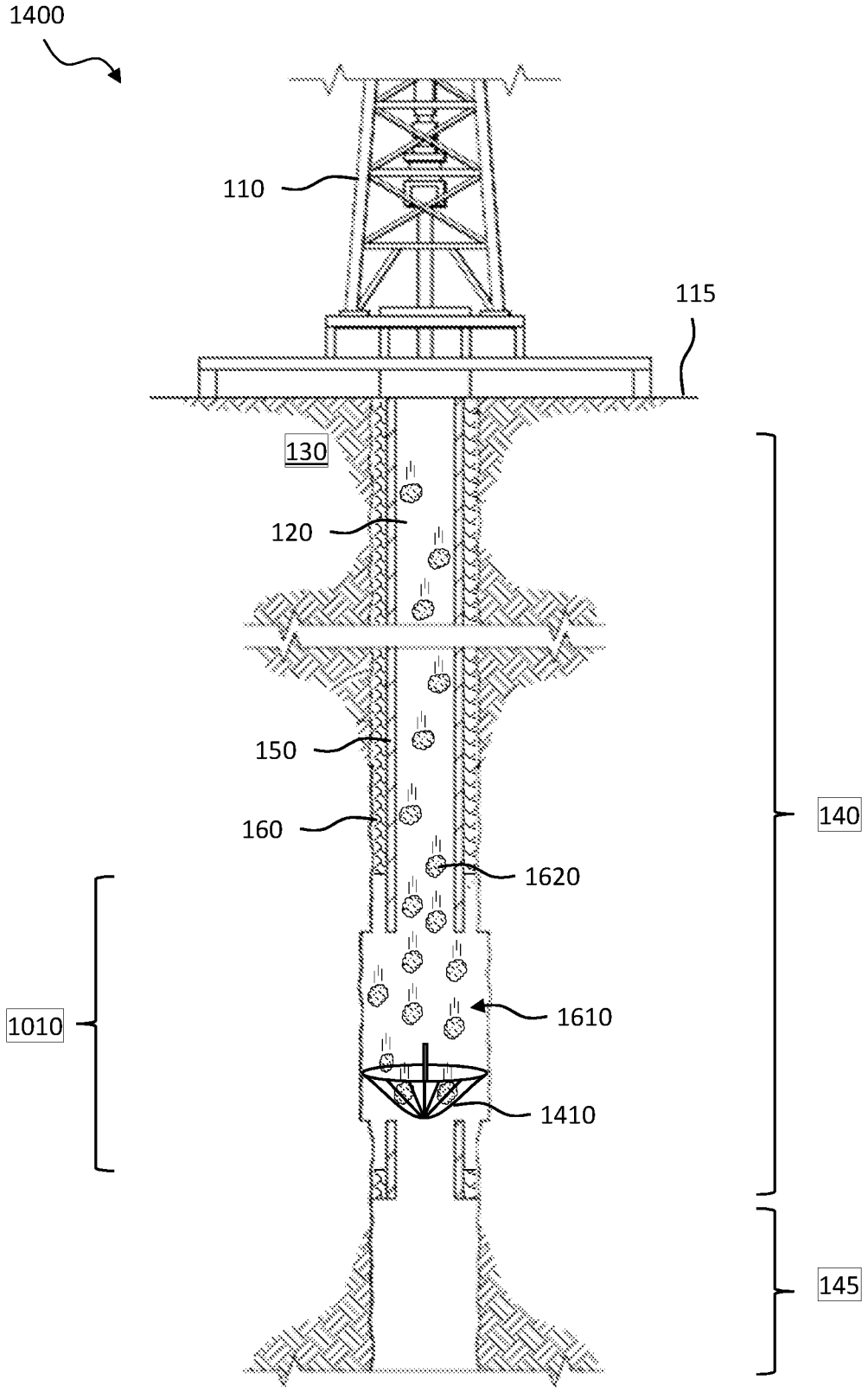

Turning now to FIG. 16, illustrated is the well system 1400 of FIG. 15 after positioning an expandable metal plug 1610 including a collection of individual separate chunks of the metal 1620 in the wellbore tubular 150. The collection of individual separate chunks of the metal 1620 may be dumped within the wellbore tubing 150, and then travel down the wellbore tubular 150 toward the radially deployable chute 1410 using gravity, or in another situation may travel down using fluid flow from the surface 115. The collective volume of the individual separate chunks of the metal 1610 will depend on the size of the expanded metal plug desired.

Figure 17:
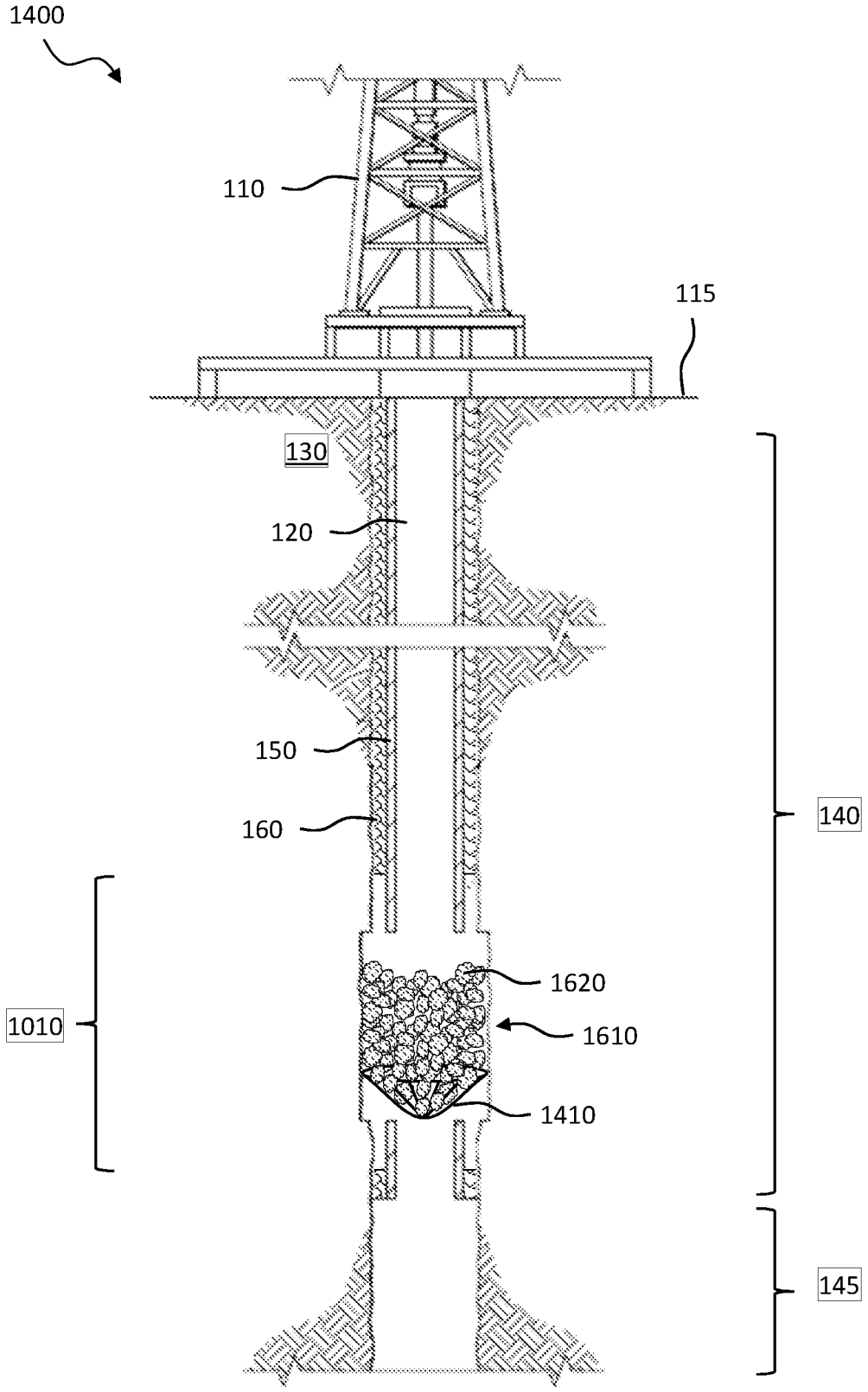

Turning now to FIG. 17, illustrated is the well system 1400 of FIG. 16 after collecting the individual separate chunks of the metal 1620 with the radially deployable chute 1410.

Figure 18:
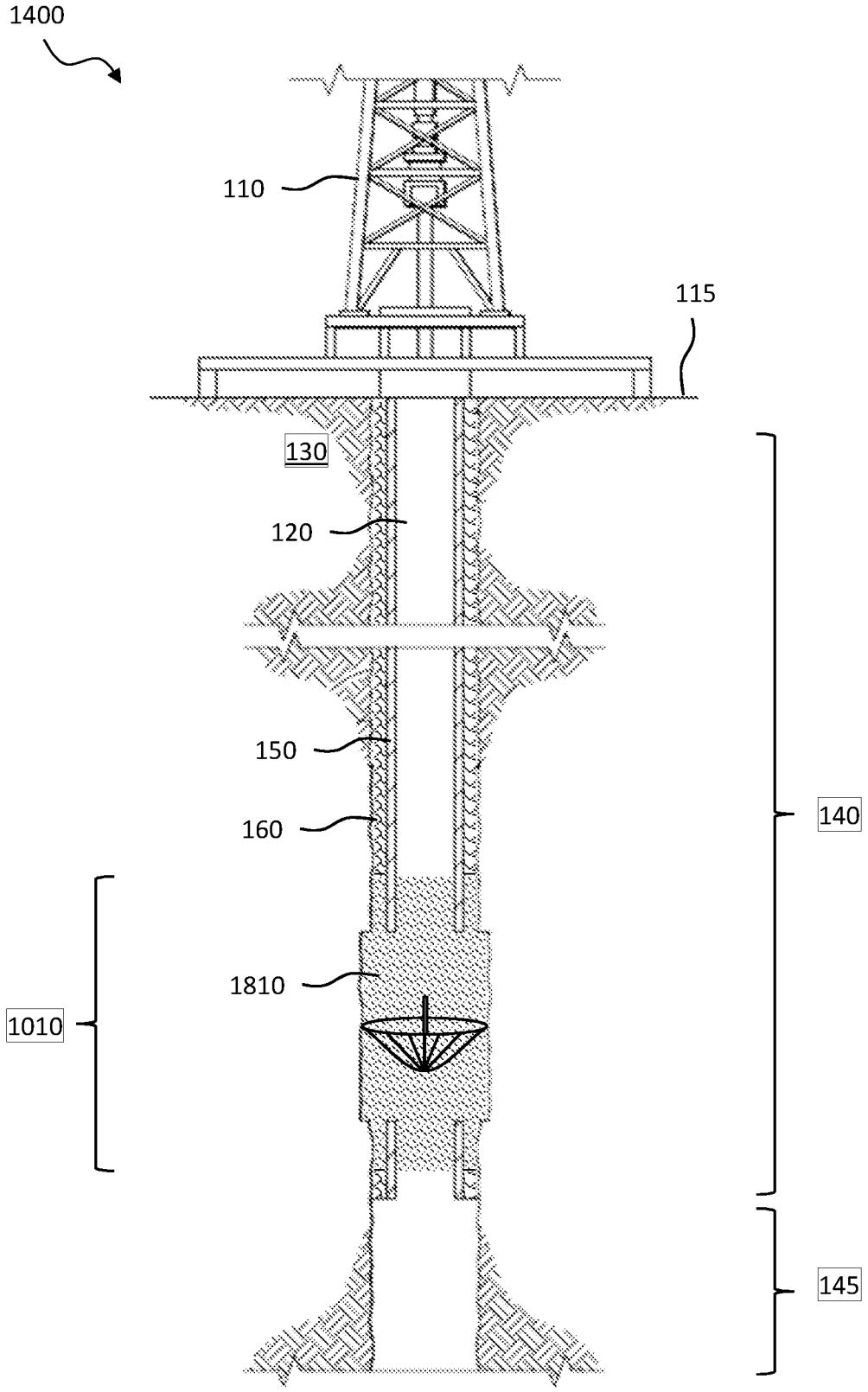

Turning now to FIG. 18, illustrated is the well system 1400 of FIG. 17 after subjecting the individual separate chunks of the metal 1620 to a wellbore fluid to expand the metal into contact with the wellbore tubular 150 and thereby plug the wellbore tubular. What results is an expanded metal plug 1810 plugging the wellbore 120. For example, in the illustrated embodiment of FIG. 18, the individual separate chunks of the metal 1620 have expanded to substantially plug an uphole and downhole portion of the remaining wellbore tubular 150 in the plug and abandonment section 1010. The individual separate chunks of the metal 1620, in the illustrated embodiment, have additionally expanded to substantially plug the diametrically enlarged area of the wellbore 120, and expanded radially into at least a portion of the exposed annulus surrounding the wellbore tubular 150 above and below the plug and abandonment section 1010.

Aspects disclosed herein include:

A. An expandable metal plug for use in a wellbore tubular, the expandable metal plug including: a downhole member positionable proximate a plug and abandonment section in a wellbore tubular, wherein at least a portion of the downhole member comprises a metal configured to expand in response to hydrolysis to seal the wellbore tubular.

B. A method for plugging and abandoning a well system, the method including: 1) positioning an expandable metal plug proximate a plug and abandonment section in a wellbore tubular, the expandable metal plug including a pre-expansion downhole member, wherein at least a portion of the pre-expansion downhole member comprises a metal configured to expand in response to hydrolysis to seal the wellbore tubular; and 2) subjecting the pre-expansion downhole member to a wellbore fluid to expand the metal into contact with the wellbore tubular and thereby form an expanded metal plug the wellbore tubular.

C. A well system, the well system including: 1) a wellbore tubular positioned within a wellbore in a subterranean formation; 2) an expanded metal plug positioned proximate a plug and abandonment section in the wellbore tubular, the expanded metal plug including a downhole member comprising a metal configured to expand in response to hydrolysis, the downhole member having expanded radially into contact with the wellbore tubular to plug the wellbore tubular.

Aspects A, B, and C may have one or more of the following additional elements in combination: Element 1: wherein the downhole member is a single plug of the metal configured to expand in response to the hydrolysis, the downhole member having a length (L) greater than a width (W) of the wellbore tubular. Element 2: wherein the downhole member is a single plug including a mixture of the metal configured to expand in response to the hydrolysis and a low melting point metal. Element 3: wherein the low melting point metal is a metal alloy having a melting point of at least 40 degrees centigrade. Element 4: further including a coating substantially surrounding the downhole member, the coating configured to delay the expansion of the metal in response to hydrolysis. Element 5: further including two or more expandable centralizers coupled to the downhole member. Element 6: wherein the two or more expandable centralizers are two or more spring loaded centralizers. Element 7: further including a radially deployable chute coupled to the downhole member, the radially deployable chute configured to catch fluid travelling through the wellbore tubular and push the expandable metal plug downhole proximate the plug and abandonment section. Element 8: wherein the downhole member is a collection of individual separate chunks of the metal held together with a binding agent. Element 9: wherein the binding agent is salt. Element 10: wherein the collection of individual separate chunks of the metal are a collection of individual separate different sized chunks of the metal. Element 11: wherein a volume of the largest most individual chunk of the metal is at least 5 times a volume of the smallest most individual chunk of the metal. Element 12: wherein a volume of the largest most individual chunk of the metal is at least 50 times a volume of the smallest most individual chunk of the metal. Element 13: wherein a diameter of the largest most individual chunk of the metal is at least 2 times a diameter of the smallest most individual chunk of the metal. Element 14: wherein a diameter of the largest most individual chunk of the metal is at least 10 times a diameter of the smallest most individual chunk of the metal. Element 15: further including a coating substantially surrounding each of the individual chunks of metal, the coating configured to delay the expansion of the metal in response to hydrolysis. Element 16: further including a radially deployable chute coupled to the collection of individual separate chunks of the metal held together with the binding agent, the radially deployable chute configured to catch the individual separate chunks of the metal when the binding agent dissolves. Element 17: wherein the radially deployable chute includes a collection of link arms that move relative to each other to radially deploy one or more petals. Element 18: wherein positioning the expandable metal plug proximate a plug and abandonment section in a wellbore tubular includes positioning the pre-expansion downhole member comprising a single plug of the metal configured to expand in response hydrolysis. Element 19: wherein positioning the expandable metal plug proximate a plug and abandonment section in a wellbore tubular includes positioning the pre-expansion downhole member comprising a mixture of the metal configured to expand in response to the hydrolysis and a low melting point metal. Element 20: wherein positioning the expandable metal plug proximate a plug and abandonment section in a wellbore tubular includes positioning the downhole member having a radially deployable chute coupled thereto. Element 21: wherein positioning the expandable metal plug proximate a plug and abandonment section in a wellbore tubular includes positioning the downhole member comprising a collection of individual separate chunks of the metal held together with a binding agent proximate the plug and abandonment section in the wellbore tubular. Element 22: wherein the collection of individual separate chunks of the metal are a collection of individual separate different sized chunks of the metal. Element 23: wherein a volume of the largest most individual chunk of the metal is at least 5 times a volume of the smallest most individual chunk of the metal. Element 24: wherein the binding agent is salt. Element 25: further including a coating substantially surrounding each of the individual chunks of metal, the coating configured to delay the expansion of the metal in response to hydrolysis. Element 26: further including positioning a radially deployable chute in the wellbore tubular, the radially deployable chute positioned downhole of the collection of individual separate chunks of the metal held together with the binding agent, the radially deployable chute configured to catch the individual separate chunks of the metal when the binding agent dissolves. Element 27: further including placing a radially deployable chute in the wellbore tubular proximate the plug and abandonment section prior to the positioning, and further wherein positioning the expandable metal plug proximate a plug and abandonment section in a wellbore tubular includes dumping a collection of individual separate chunks of the metal in the wellbore tubular, the collection of individual separate chunks of the metal collected by the radially deployable chute. Element 28: further including dumping a collection of individual separate chunks of low melting point metal in the wellbore tubular with the collection of individual separate chunks of the metal. Element 29: further including removing a portion of the wellbore tubular to at least partially expose an annulus surrounding the wellbore tubular prior to the positioning, the subjecting expanding the metal at least partially into the annulus. Element 30: wherein a portion of the wellbore tubular has been removed proximate the plug and abandonment section thereby exposing an annulus surrounding the wellbore tubular, and further wherein the downhole member has expanded radially into the annulus. Element 31: wherein a volume of the expanded downhole member is at least 3500 $cm^3$. Element 32: wherein a volume of the expanded downhole member is at least 775,000 $cm^3$. Element 33: wherein a length ($L_e$) of the expanded downhole member is at least 90 cm. Element 34: wherein a length ($L_e$) of the expanded downhole member is at least 1500 cm. Element 35: wherein the expanded downhole member includes residual unreacted metal.

Those skilled in the art to which this application relates will appreciate that other and further additions, deletions, substitutions and modifications may be made to the described embodiments.

What is claimed is:

1. An expandable metal plug, comprising:

a downhole member positionable proximate a plug and abandonment section in a wellbore tubular, wherein at least a portion of the downhole member comprises a metal configured to expand in response to hydrolysis to seal the wellbore tubular, wherein an amount of the metal configured to expand in response to hydrolysis is sufficient to expand to a volume of at least 3500 $cm^3$, further wherein during the expansion the metal configured to expand in response to hydrolysis is configured to go from metal to micron-scale particles that are larger and lock together.

2. The expandable metal plug as recited in claim 1, wherein the downhole member is a single plug of the metal configured to expand in response to the hydrolysis, the downhole member having a length (L) and a width (W), the length (L) greater than the width (W).

3. The expandable metal plug as recited in claim 1, wherein the downhole member is a single plug including a mixture of the metal configured to expand in response to the hydrolysis and a fusible alloy.

4. The expandable metal plug as recited in claim 3, wherein the fusible alloy is an alloy containing bismuth, antimony, gallium, tin, zinc, lead, indium, or cadmium.

5. The expandable metal plug as recited in claim 1, further including a coating surrounding the downhole member, the coating configured to delay the expansion of the metal in response to hydrolysis.

6. The expandable metal plug as recited in claim 1, further including two or more expandable centralizers coupled to the downhole member.

7. The expandable metal plug as recited in claim 6, wherein the two or more expandable centralizers are two or more spring loaded centralizers.

8. The expandable metal plug as recited in claim 1, further including a radially deployable chute coupled to the downhole member, the radially deployable chute configured to catch fluid travelling through the wellbore tubular and move the expandable metal plug downhole proximate the plug and abandonment section.

9. The expandable metal plug as recited in claim 1, wherein the downhole member is a collection of individual separate chunks of the metal held together with a binding agent.

10. The expandable metal plug as recited in claim 9, wherein the binding agent is a salt.

11. The expandable metal plug as recited in claim 9, wherein the collection of individual separate chunks of the metal are a collection of individual separate different sized chunks of the metal.

12. The expandable metal plug as recited in claim 11, wherein a volume of the largest most individual chunk of the metal is at least 5 times a volume of the smallest most individual chunk of the metal.

13. The expandable metal plug as recited in claim 11, wherein a volume of the largest most individual chunk of the metal is at least 50 times a volume of the smallest most individual chunk of the metal.

14. The expandable metal plug as recited in claim 11, wherein a diameter of the largest most individual chunk of the metal is at least 2 times a diameter of the smallest most individual chunk of the metal.

15. The expandable metal plug as recited in claim 11, wherein a diameter of the largest most individual chunk of the metal is at least 10 times a diameter of the smallest most individual chunk of the metal.

16. The expandable metal plug as recited in claim 9, further including a coating surrounding each of the individual chunks of metal, the coating configured to delay the expansion of the metal in response to hydrolysis.

17. The expandable metal plug as recited in claim 9, further including a radially deployable chute coupled to the collection of individual separate chunks of the metal held together with the binding agent, the radially deployable chute configured to catch the individual separate chunks of the metal when the binding agent dissolves.

18. The expandable metal plug as recited in claim 17, wherein the radially deployable chute includes a collection of link arms that move relative to each other to radially deploy one or more petals.

19. A well system, comprising:

a wellbore tubular positioned within a wellbore in a subterranean formation;

an expanded metal plug positioned proximate a plug and abandonment section in the wellbore tubular, the expanded metal plug including a downhole member comprising a metal configured to expand in response to hydrolysis, the downhole member having expanded radially into contact with the wellbore tubular to plug the wellbore tubular, wherein a volume of the expanded downhole member is at least 3500 $cm^3$, further wherein during the expansion the metal configured to expand in response to hydrolysis is configured to go from metal to micron-scale particles that are larger and lock together.

20. The well system as recited in claim 19, wherein a portion of the wellbore tubular has been removed proximate the plug and abandonment section thereby exposing an annulus surrounding the wellbore tubular, and further wherein the downhole member has expanded radially into the annulus.

21. The well system as recited in claim 19, wherein the volume of the expanded downhole member is at least 775,000 $cm^3$.

22. The well system as recited in claim 19, wherein a length ($L_e$) of the expanded downhole member is at least 90 cm.

23. The well system as recited in claim 19, wherein a length ($L_e$) of the expanded downhole member is at least 1500 cm.

24. The well system as recited in claim 19, wherein the expanded downhole member includes residual unreacted metal.

25. A well system, comprising:

a wellbore tubular positioned within a wellbore in a subterranean formation, the wellbore tubular having an uphole end and a downhole end;

one or more removed sections in the wellbore tubular located between the uphole end and the downhole end;

an expandable metal plug positioned within the wellbore tubular, the expandable metal plug comprising:

a downhole member positioned proximate the one or more removed sections in the wellbore tubular, wherein at least a portion of the downhole member comprises a metal configured to expand in response to hydrolysis, and further wherein an amount of the metal configured to expand in response to hydrolysis is sufficient to expand to a volume of at least 3500 $cm^3$ to seal the wellbore tubular and the one or more removed sections, further wherein during the expansion the metal configured to expand in response to hydrolysis is configured to go from metal to micron-scale particles that are larger and lock together.

26. The well system as recited in claim 25, wherein the one or more removed sections is a one or more longitudinal removed sections in the wellbore tubular.

27. The well system as recited in claim 25, wherein the one or more removed sections is a plurality of perforations in the wellbore tubular.

* * * * *